US007885571B2

(12) United States Patent
Omura

(10) Patent No.: US 7,885,571 B2
(45) Date of Patent: Feb. 8, 2011

(54) IMAGE FORMING APPARATUS, FIXING UNIT, AND HEATING SYSTEM CAPABLE OF HEATING AT INCREASED SPEED WITH REDUCED POWER

(75) Inventor: Ken Omura, Machida (JP)

(73) Assignee: Ricoh Company, Ltd., Tokyo (JP)

( * ) Notice: Subject to any disclaimer, the term of this patent is extended or adjusted under 35 U.S.C. 154(b) by 639 days.

(21) Appl. No.: 11/520,649

(22) Filed: Sep. 14, 2006

(65) Prior Publication Data

US 2007/0059017 A1 Mar. 15, 2007

(30) Foreign Application Priority Data

Sep. 14, 2005 (JP) ..... 2005-267084

(51) Int. Cl.
*G03G 15/00* (2006.01)

(52) U.S. Cl. ..... 399/88; 399/67; 399/69; 399/328

(58) Field of Classification Search ..... 399/67, 399/69, 88, 328
See application file for complete search history.

(56) References Cited

U.S. PATENT DOCUMENTS

| | | | | |
|---|---|---|---|---|
| 2002/0098434 | A1* | 7/2002 | Anno et al. | 430/108.8 |
| 2004/0156661 | A1* | 8/2004 | Kagawa et al. | 399/328 |
| 2004/0245235 | A1* | 12/2004 | Kishi et al. | 219/216 |
| 2005/0163529 | A1* | 7/2005 | Teshigawara | 399/328 |
| 2005/0163543 | A1 | 7/2005 | Satoh et al. | |
| 2005/0175368 | A1* | 8/2005 | Matsusaka et al. | 399/69 |
| 2005/0191098 | A1 | 9/2005 | Ueno et al. | |
| 2006/0029411 | A1 | 2/2006 | Ishii et al. | |

FOREIGN PATENT DOCUMENTS

| | | |
|---|---|---|
| JP | 10-010913 | 1/1998 |
| JP | 10-217356 | 8/1998 |
| JP | 10-282821 | 10/1998 |
| JP | 10-301415 | 11/1998 |
| JP | 2000-162911 | 6/2000 |
| JP | 2002-174988 | 6/2002 |
| JP | 2003-140484 | 5/2003 |
| JP | 2003-271044 | 9/2003 |
| JP | 2004-200149 | 7/2004 |
| JP | 2004-272226 | 9/2004 |
| JP | 2004-332929 | 11/2004 |
| JP | 2005-024784 | 1/2005 |
| JP | 2005-189268 | 7/2005 |

* cited by examiner

*Primary Examiner*—Ryan D Walsh
(74) *Attorney, Agent, or Firm*—Oblon, Spivak, McClelland, Maier & Neustadt, L.L.P.

(57) ABSTRACT

An image forming apparatus includes an image forming mechanism configured to form a toner image on a recording medium with a toner according to image data and a fixing unit configured to fix the toner image on the recording medium. The fixing unit includes first and second heating members and a first heater. The first and second heating members are configured to apply heat to the recording medium having the toner image. The first heater is configured to heat the second heating member. The image forming apparatus further includes an auxiliary power source configured to drive the first heater.

8 Claims, 8 Drawing Sheets

IMAGE FORMING APPARATUS, FIXING UNIT, AND HEATING SYSTEM CAPABLE OF HEATING AT INCREASED SPEED WITH REDUCED POWER

CROSS-REFERENCE TO RELATED APPLICATION

The present application is based on and claims priority to Japanese patent application No. 2005-267084 filed on Sep. 14, 2005 in the Japan Patent Office, the entire contents of which are hereby incorporated herein by reference.

BACKGROUND

1. Field of Invention

Exemplary aspects of the present invention relate to an image forming apparatus, a fixing unit, and a heating system, and more particularly to an image forming apparatus, a fixing unit, and a heating system for heating the fixing unit for fixing a toner image on a recording medium.

2. Description of the Related Art

A related art image forming apparatus, such as a copying machine, a facsimile machine, a printer, or a multifunction printer including copying, printing, scanning, and facsimile functions, forms an electrostatic latent image on a photoconductor according to image data. The electrostatic latent image is developed with a developer (e.g., a toner) to form a toner image on the photoconductor. The toner image is transferred onto a recording medium (e.g., a sheet) and sent to a fixing unit. In the fixing unit, heat and pressure are applied to the sheet having the transferred toner image to fix the toner image on the sheet. The fixing unit may generate the heat in an induction heating method to shorten a warm-up time period and to save energy.

An example fixing unit using the induction heating method includes a heating roller, a fixing roller, a fixing belt looped over the heating roller and the fixing roller, an induction heater opposing the heating roller via the fixing belt, and a pressing roller opposing the fixing roller via the fixing belt The induction heater includes a coil extending in a width direction of the fixing belt (i.e., a direction perpendicular to a sheet conveyance direction).

The fixing belt is rotated and heated by the induction heater while the fixing belt passes under the induction heater. The heated fixing belt applies heat to a sheet having a toner image when the sheet is conveyed through a nip formed between the fixing belt and the pressing roller so as to fix the toner image on the sheet. Specifically, a high-frequency alternating current is applied to the coil to form a magnetic field around the coil. The magnetic field induces an eddy current on a surface of the heating roller. Electric resistances of the heating roller generate Joule heat to heat the fixing belt looped over the heating roller.

The related art image forming apparatus is expected to consume less power for environmental protection. To achieve this goal, the fixing unit maintains a temperature of the heating roller at a level lower than a proper fixing temperature while the image forming apparatus is in a standby mode. The heating roller is heated up to the proper fixing temperature when the image forming apparatus starts an image forming operation. However, the fixing unit still consumes power while the image forming apparatus is in the standby mode and the fixing unit does not perform a fixing operation.

The related art image forming apparatus is further expected to reduce power consumed even in the standby mode. However, when the image forming apparatus is configured to supply no power to the fixing unit in the standby mode, it may take a long time period to heat the heating roller up to the proper fixing temperature, because the heating roller includes a metal having a high heat capacity.

To heat the heating roller in a shorter time period, an example related art image forming apparatus includes a main power source and an auxiliary power source. When the image forming apparatus is in the standby mode, a battery of the auxiliary power source is charged. The main power source and the auxiliary power source supply power to the fixing unit to warm up the fixing unit in a shortened time period. However, the pressing roller may draw heat from the fixing belt when the fixing unit is warmed up in the shortened time period.

Another example fixing unit includes a thermal insulator disposed to cover the fixing roller and the pressing roller to prevent the fixing roller and the pressing roller from being cooled down. However, the thermal insulator has a high thermal conductivity and may not suppress heat dispersion from the fixing unit.

SUMMARY OF THE INVENTION

This specification describes below an image forming apparatus according to an exemplary embodiment of the invention. In one aspect of the present invention, the image forming apparatus includes an image forming mechanism configured to form a toner image on a recording medium with a toner according to image data and a fixing unit configured to fix the toner image on the recording medium. The fixing unit includes first and second heating members and a first heater. The first and second heating members are configured to apply heat to the recording medium having the toner image. The first heater is configured to heat the second heating member. The image forming apparatus further includes an auxiliary power source configured to drive the first heater.

This specification further describes a fixing unit for fixing a toner image on a recording medium according to one exemplary embodiment of the invention. In one aspect of the present invention, the fixing unit includes first and second heating members and a first heater. The first and second heating members are configured to apply heat to the recording medium having the toner image. The first heater is configured to heat the second heating member.

This specification further describes a heating system for applying heat to a recording medium having a toner image to fix the toner image on the recording medium according to one exemplary embodiment of the invention. In one aspect of the present invention, the heating system includes first and second heating members, a first heater, and an auxiliary power source. The first and second heating members are configured to apply heat to the recording medium having the toner image. The first heater is configured to heat the second heating member. The auxiliary power source is configured to drive the first heater and including a capacitor.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE EXEMPLARY EMBODIMENTS

Figure 1:
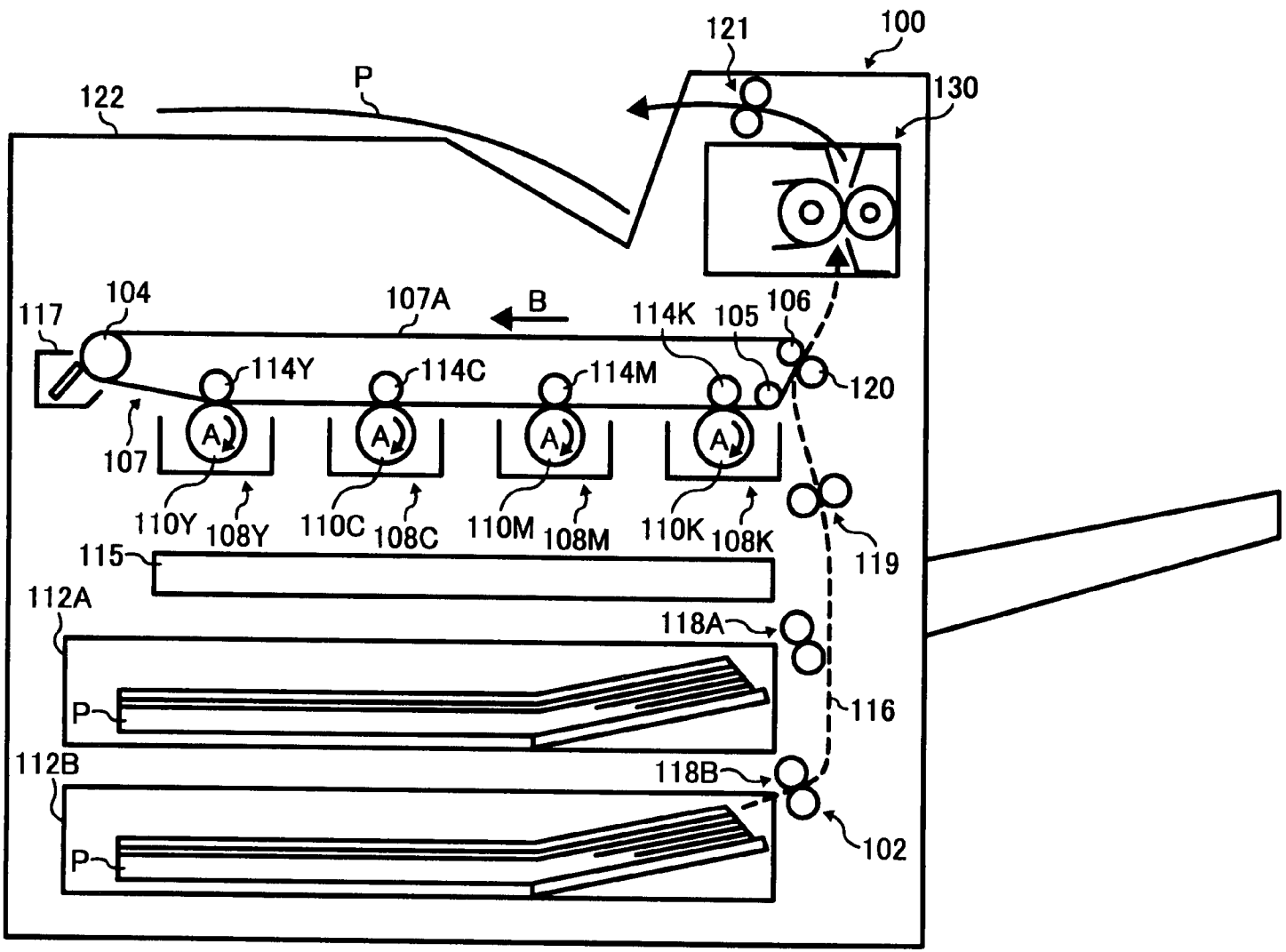
FIG. 1 is a schematic view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, in particular to FIG. 1, an image forming apparatus 100 according to an exemplary embodiment of the present invention is explained.

As illustrated in FIG. 1, the image forming apparatus 100 includes image forming units 108Y, 108C, 108M, and 108K, an exposure unit 115, an intermediate transfer unit 107, a paper tray unit 102, a conveying path 116, a registration roller pair 119, a second transfer roller 120, a fixing unit 130, an output roller pair 121, and an output tray 122.

The image forming units 108Y, 108C, 108M, and 108K respectively include photoconductors 110Y, 110C, 110M, and 110K. The intermediate transfer unit 107 includes an intermediate transfer belt 107A, rollers 104, 105, and 106, first transfer rollers 114Y, 114C, 114M, and 114K, and abet cleaner 117. The paper tray unit 102 includes paper trays 112A and 112B and feeding roller pairs 118A and 118B.

The image forming apparatus 100 may be a copying machine, a facsimile machine, a printer, or a multifunction printer including copying, printing, scanning, and facsimile functions. According to this non-limiting exemplary embodiment of the present invention, the image forming apparatus 100 functions as a color printer for printing a color image on a recording medium using an electrophotographic method.

The image fanning units 108Y, 108C, 108M, and 108K respectively form toner images in yellow, cyan, magenta, and black colors and are attachable to and detachable form the image forming apparatus 100. Each of the image forming units 108Y, 108C, 108M, and 108K further includes a charger (not shown), a development unit (not shown), a cleaner (not shown), and a discharger (not shown), which are disposed around each of the photoconductors 110Y, 110C, 110M, and 110k.

A driver (not shown) drives each of the photoconductors 110Y, 110C, 110M, and 110K to rotate in a rotating direction A. The charger of each of the image forming units 108Y, 108C, 108M, and 108K uniformly charges a surface of each of the photoconductors 110Y, 110C, 110M, and 110K with a predetermined polarity.

The exposure unit 115 is disposed under the image forming units 108Y, 108C, 108M, and 108K and emits light (e.g., a laser beam) upward onto the charged surface of each of the photoconductors 110Y, 110C, 110M, and 110K according to image data so as to form an electrostatic latent image on the surface of each of the photoconductors 110Y, 110C, 110M, and 110K The image data includes yellow, cyan, magenta, and black image data created by breaking down color image data. Namely, the exposure unit 115 emits laser beams onto the surfaces of the photoconductors 110Y, 110C, 110M, and 110K according to the yellow, cyan, magenta, and black image data to form electrostatic latent images corresponding to the yellow, cyan, magenta, and black image data.

The development units of the image forming units 108Y, 108C, 108M, and 108K respectively contain yellow, cyan, magenta, and black toners. When the electrostatic latent images formed on the surfaces of the rotating photoconductors 110Y, 110C, 110M, and 110K respectively oppose the development units, the development units develop the electrostatic latent images with the yellow, cyan, magenta, and black toners to form yellow, cyan, magenta, and black toner images.

The intermediate transfer unit 107 carries the toner images transferred from the image forming units 108Y, 108C, 108M, and 108K The intermediate transfer belt 107A is formed in an endless belt-like shape having flexibility and is looped over the rollers 104, 105, and 106. A driver (not shown) drives at least one of the rollers 104, 105, and 106 to rotate the intermediate transfer belt 107A in a rotating direction B. The intermediate transfer belt 107A opposes the photoconductors 110Y, 110C, 110M, and 110K The first transfer rollers 114Y, 114C, 114M, and 114K contact an inner circumferential surface of the intermediate transfer belt 107A and respectively oppose the photoconductors 110Y, 110C, 110M, and 110K via the intermediate transfer belt 107A. A power source (not shown) applies a first transfer bias to the first transfer rollers 114Y, 114C, 114M, and 114K.

The first transfer roller 114Y transfers the yellow toner image formed on the surface of the photoconductor 110Y onto an outer circumferential surface of the intermediate transfer belt 107A. The first transfer roller 114C transfers and superimposes the cyan toner image formed on the surface of the photoconductor 110C onto the yellow toner image transferred on the outer circumferential surface of the intermediate transfer belt 107A. The first transfer roller 114M transfers and superimposes the magenta toner image formed on the surface of the photoconductor 110M onto the cyan toner image transferred and superimposed on the yellow toner image on the outer circumferential surface of the intermediate transfer belt 107A. The first transfer roller 114K transfers and superimposes the black toner image formed on the surface of the photoconductor 110K onto the magenta toner image transferred and superimposed on the cyan toner image transferred and superimposed on the yellow toner image transferred on the outer circumferential surface of the intermediate transfer belt 107A. Thus, a color toner image is formed on the outer circumferential surface of the intermediate transfer belt 107A.

The cleaners respectively remove residual toners remaining on the surfaces of the photoconductors 110Y, 110C, 110M, and 110K after the yellow, cyan, magenta, and black toner images respectively formed on the surfaces of the photoconductors 110Y, 110C, 110M, and 110K are transferred onto the outer circumferential surface of the intermediate transfer belt 107A. Then, the dischargers discharge the surfaces of the photoconductors 110Y, 110C, 110M, and 110K. Thus, the surface potentials of the photoconductors 110Y, 110C, 110M, and 110K are initialized to become ready for next image forming processing.

The paper tray unit 102 is disposed in a lower portion of the image forming apparatus 100. The paper trays 112A and 112B load a recording medium (e.g., sheets P). The feeding roller pair 118A or 118B rotates to feed a sheet P from the paper tray 112A or 112B toward the registration roller pair 119 through the conveying path 116.

The conveying path 116 extends from the paper tray unit 102 to the output roller pair 121 and conveys the sheet P. The registration roller pair 119 is disposed upstream of the second transfer roller 120 in a sheet conveyance direction on the conveying path 116. The registration roller pair 119 feeds the sheet P to a second transfer nip at a time when the color toner image formed on the outer circumferential surface of the intermediate transfer belt 107A is properly transferred onto the sheet P at the second transfer nip. The second transfer nip is formed by the second transfer roller 120 and the intermediate transfer belt 107A opposing and contacting each other. The second transfer roller 120 opposes the roller 106 via the intermediate transfer belt 107A at the second transfer nip. Namely, the second transfer roller 120 and a portion of the intermediate transfer belt 107A face the conveying path 116. The power source applies a second transfer bias having a polarity opposite to a polarity of the color toner image formed on the outer circumferential surface of the intermediate transfer belt 107A to the second transfer roller 120. Thus, the second transfer roller 120 transfers the color toner image formed on the outer circumferential surface of the intermediate transfer belt 107A onto the sheet P.

The belt cleaner 117 opposes the roller 104 via the intermediate transfer belt 107A and removes a residual toner remaining on the outer circumferential surface of the intermediate transfer belt 107A after the color toner image formed on the outer circumferential surface of the intermediate transfer belt 107A is transferred onto the sheet P. The intermediate transfer unit 107 including the intermediate transfer belt 107A, the rollers 104, 105, and 106, the first transfer rollers 114Y, 114C, 114M, and 114K, and the belt cleaner 117 is formed in a single unit and is attachable to and detachable from the image forming apparatus 100.

The sheet P having the color toner image is fed by the second transfer roller 120 and the intermediate transfer belt 107A toward the fixing unit 130. The fixing unit 130 applies heat and pressure to the sheet P having the color toner image while the sheet P is conveyed in the fixing unit 130 so as to melt and fix the color toner image on the sheet P. The sheet P having the fixed color toner image is fed toward the output roller pair 121. The output roller pair 121 feeds the sheet P having the fixed color toner image onto the output tray 122. The output tray 122 is disposed on top of the image forming apparatus 100 and receives the sheet P fed by the output roller pair 121.

Figure 2:
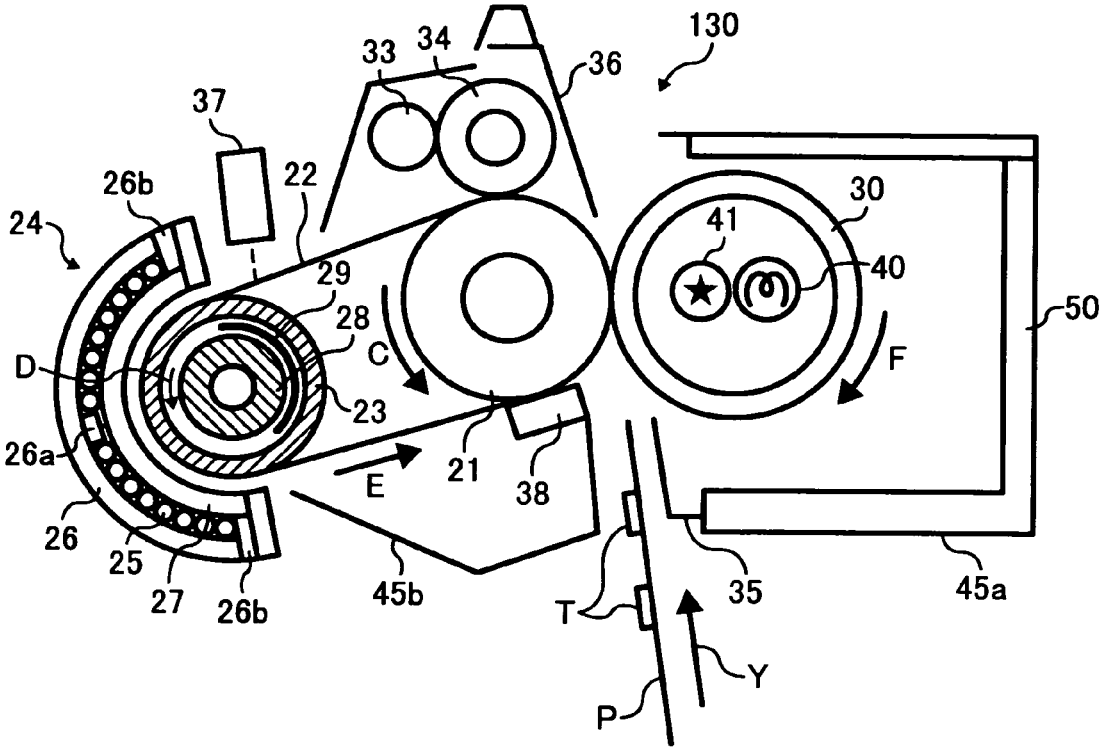
FIG. 2 is a sectional view of a fixing unit of the image forming apparatus shown in FIG. 1.

As illustrated in FIG. 2, the fixing unit 130 includes a fixing roller 21, a support roller 23, an inside core 28, a shield 29, a fixing belt 22, an induction heater 24, a pressing roller 30, a halogen heater 40, a capacitor heater 41, a guide 35, a separator 36, an oil applying roller 34, a cleaning roller 33, a thermopile 37, a thermistor 38, housings 45*a* and 45*b*, and a thermal insulator 50. The induction heater 24 includes a coil 25, a coil guide 27, and a core 26. The core 26 includes a center core 26*a* and side cores 26*b*.

The fixing roller 21 includes an elastic layer including a silicone rubber as a surface layer. A driver (not shown) drives the fixing roller 21 to rotate in a rotating direction C. The support roller 23 is formed in a cylinder-like shape and includes a non-magnetic material including stainless steel SUS 304 and/or SUS 316. The support roller 23 rotates in a rotating direction D. The inside core 28 and the shield 29 are rotatably disposed inside the cylinder of the support roller 23. The inside core 28 includes a ferromagnet including ferrite. The shield 29 covers an outer circumferential surface of a part of the inside core 28. The inside core 28 opposes the induction heater 24 via the support roller 23 and the fixing belt 22. A driver (not shown) drives and rotates the inside core 28 and the shield 29 independently of the support roller 23.

The fixing belt 22 is looped over the fixing roller 21 and the support roller 23 and is supported by the fixing roller 21 and the support roller 23. The fixing belt 22 is formed in an endless belt-like shape and has a multilayered structure including a heating layer, an elastic layer, and a releasing layer formed on a base layer. The base layer may include a heat-resistant resin material including fluoroplastic such as a polyimide resin, a polyamide-imide resin, a PEEK (polyetheretherketone) resin, a PES (polyethersulfone) resin, a PPS (polyphenylene sulfide) resin, and/or the like. The heating layer may include nickel, stainless steel, iron, copper, cobalt, chrome aluminum, gold, platinum, silver, tin, palladium, an alloy of two or more of the above-described metals, and/or the like. The elastic layer may include a silicone rubber, a fluoro silicone rubber, and/or the like. The releasing layer may include fluoroplastic such as a PTFE (polytetrafluoroethylene) resin, a PFA (tetrafluoroethylene-perfluoroalkylvinylether) copolymer resin, a mixture of two or more of the above-described resins, and/or the like.

According to this non-limiting exemplary embodiment, the base layer and the heating layer form a mixed layer. Specifically, three heating layers including silver are inserted in the base layer including polyimide in a state that the heating layers are spaced alternately with the base layers. The elastic layer is formed on the mixed layer and the releasing layer is formed on the elastic layer. However, the fixing belt 22 may be formed in the endless belt-like shape and may have a multilayered structure including the base layer, the elastic layer, and the releasing layer. Accordingly, the fixing belt 22 may not generate heat but the heated support roller 23 may heat the fixing belt 22. In this case, the support roller 23 may include a base layer including stainless steel SUS and/or iron and a heat generating layer including silver and/or copper. The base layer may be coated with the heat generating layer having a thickness in a range of from about 5 μm to about 200 μm to increase heating efficiency. The support roller 23 may further include a protecting layer including nickel. The heat generating layer may be coated with the protecting layer. The fixing belt 22 may include the heating layer so that both the fixing belt 22 and the support roller 23 may be heated. The fixing belt 22 may include a heat generating layer which generates heat when power is supplied from a main power source (shown below) via a power feeder (not shown). In this case, the support roller 23 may be or may not be configured to generate heat.

The induction heater 24 generates a magnetic flux. The induction heater 24 includes the coil 25 and optionally includes the coil guide 27 and the core 26. The coil 25 covers an outer circumferential surface of a part of the fixing belt 22, the part contacted by the support roller 23. The coil 25 includes litz wires including bunched fine wires coiled and extended in a width direction of the fixing belt 22. The coil 25 is connected to a high-frequency power source (not shown) of the main power source. The high-frequency power source applies an alternating current in a range of from about 10 kHz to about 1 MHz to the coil 25. The coil guide 27 includes a heat-resistant resin material. The coil guide 27 supports the coil 25 and forms a frame of the induction heater 24. The core 26 includes a ferromagnet including ferrite having a relative permeability of about 2,500 and opposes the coil 25 extended in the width direction of the fixing belt 22. The center core 26*a* is disposed near a center of the coil 25 in a circumferential direction of the coil 25, at which the magnetic fluxes are generated at a high density. The side cores 26*b* are disposed symmetrically with respect to the center core 26*a*.

The pressing roller 30 applies pressure to the fixing roller 21 via the fixing belt 22. The pressing roller 30 opposes and contacts the fixing belt 22 to form a fixing nip to which a sheet P having a toner image T is conveyed in a direction Y. The pressing roller 30 applies heat and pressure to the sheet P having the toner image T. The pressing roller 30 includes a cylinder including aluminum, copper, stainless steel, and/or the like and an elastic layer including a fluorocarbon rubber, a silicone rubber, and/or the like. The elastic layer is formed on the cylinder and has a thickness in a range of from about 1 mm to about 5 mm and an Asker C hardness in a range of from about 20 degrees centigrade to about 60 degrees centigrade.

The halogen heater 40 and the capacitor heater 41 are disposed inside the cylinder of the pressing roller 30 and generate heat.

The guide 35 is disposed upstream of the fixing nip formed between the fixing belt 22 and the pressing roller 30 in the sheet conveyance direction and guides the sheet P toward the fixing nip. The separator 36 is disposed downstream of the fixing nip formed between the fixing belt 22 and the pressing roller 30 in the sheet conveyance direction, and separates the sheet P from the fixing belt 22 and guides the sheet P toward the output roller pair 121.

The oil applying roller 34 contacts an outer circumferential surface of the fixing belt 22 and supplies an oil (e.g., a silicone oil) to the outer circumferential surface of the fixing belt 22. Thus, a toner may be easily released from the outer circumferential surface of the fixing belt 22. The cleaning roller 33 contacts the oil applying roller 34 and cleans an outer circumferential surface of the oil applying roller 34.

The thermopile 37 opposes the outer circumferential surface of the fixing belt 22 and is disposed near a center of the fixing belt 22 in the width direction of the fixing belt 22. The thermopile 37 includes a temperature sensor for detecting a temperature of the outer circumferential surface of the fixing belt 22 without contacting the fixing belt 22. The thermistor 38 contacts the outer circumferential surface of the fixing belt 22 and is disposed near an end portion of the fixing belt 22 in the width direction of the fixing belt 22. The thermistor 38 includes a temperature sensor for detecting the temperature of the outer circumferential surface of the fixing belt 22 by contacting the fixing belt 22.

The housing 45*a* covers the pressing roller 30. The housing 45*b* covers the fixing belt 22. The thermal insulator 50 is disposed on an interior of the housing 45*a* and reduces heat radiation.

Figure 3:
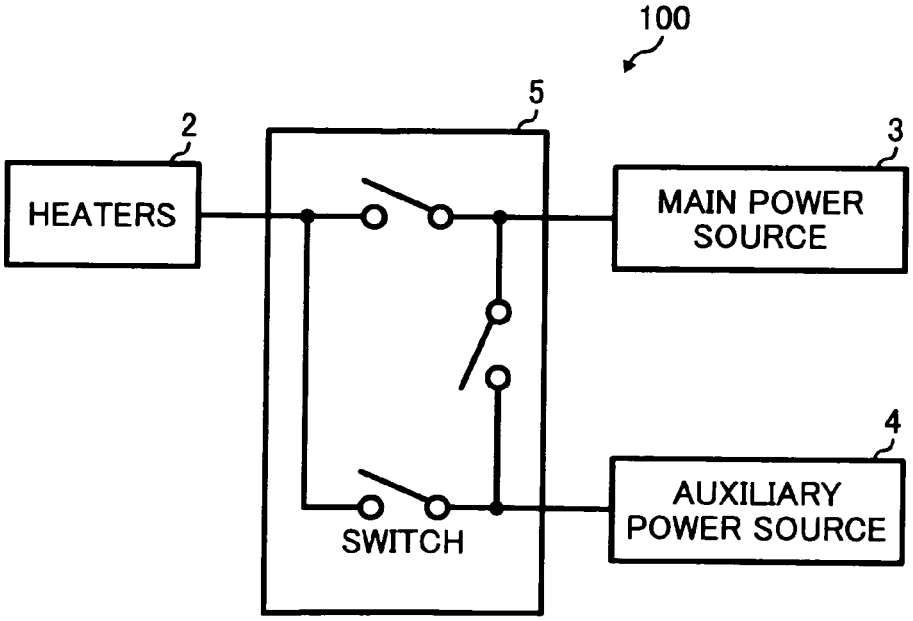
FIG. 3 is a block diagram of a heating system of the fixing unit shown in FIG. 2.

As illustrated in FIG. 3, the image forming apparatus 100 further includes a main power source 3, an auxiliary power source 4, a switch 5, and heaters 2, which form a heating system.

The main power source 3 supplies power to the halogen heater 40 and the induction heater 24 to drive the halogen heater 40 and the induction heater 24. The auxiliary power source 4 includes a capacitor which supplies power to the capacitor heater 41 to drive the capacitor heater 41. The switch 5 controls the power supply from the auxiliary power source 4 to the capacitor heater 41 based on a temperature of an outer circumferential surface of the pressing roller 30 detected by a temperature sensor (not shown) including a thermistor and a non-contact temperature sensor or a temperature of the outer circumferential surface of the fixing belt 22 detected by the thermistor 38, so that the temperature of the pressing roller 30 reaches a predetermined temperature. The switch 5 controls the power supply from the main power source 3 to the halogen heater 40 based on the temperature of the outer circumferential surface of the pressing roller 30 detected by the temperature sensor (e.g., the thermistor) contacting the pressing roller 30,50 that the temperature of the pressing roller 30 reaches a predetermined temperature. The switch 5 controls the power supply from the main power source 3 to the induction heater 24 including an inverter circuit based on the temperature of the outer circumferential surface of the fixing belt 22 detected by the thermopile 37 and the thermistor 38,so that the temperature of the fixing belt 22 (i.e., a fixing temperature) is maintained. The heaters 2 include the induction heater 24, the halogen heater 40, the capacitor heater 41, the fixing roller 21, the fixing belt 22, the support roller 23, and the pressing roller 30.

When the heated support roller 23 is configured to heat the fixing roller 21 and the pressing roller 30 up to a temperature appropriate for fixing, and there is no specific heater provided for heating the pressing roller 30, the fixing belt 22 may be heated quickly by the induction heater 24, and the heated fixing belt 22 may heat the fixing roller 21. However, the pressing roller 30 may not be heated quickly. The pressing roller 30 includes a surface layer including a fluorocarbon tube and an elastic body, and a core including a metal (e.g., aluminum, stainless steel, iron, and/or the like) having a thickness of several millimeters.

The pressing roller 30 includes a core having a high heat capacity and a surface layer having a low thermal conductivity. Thus, it takes time before the pressing roller 30 is thermally stabilized. Even if the fixing belt 22 has a low heat capacity, the pressing roller 30 having the high heat capacity may draw heat from the fixing belt 22, preventing a warm-up time period of the fixing unit 130 from being shortened.

When there is no specific heater provided for heating the pressing roller 30, the fixing temperature may substantially decrease before the image forming apparatus 100 in a standby mode starts an image forming operation. When the pressing roller 30, which is not sufficiently heated, contacts the fixing belt 22 before the fixing unit 130 is thermally stabilized, the pressing roller 30 may decrease the temperature of the fixing belt 22. As a result, a faulty image may be formed on a sheet P due to defective fixing.

Figure 4:
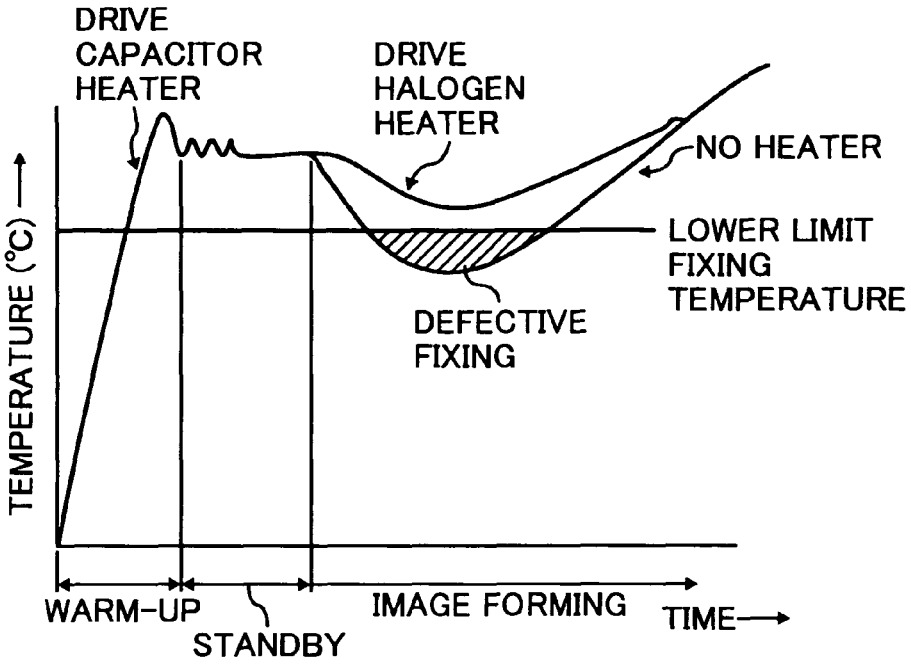
FIG. 4 is a graph illustrating a temperature change of a fixing belt of the fixing unit shown in FIG. 2.

FIG. 4 illustrates the temperature (i.e., the fixing temperature) of the outer circumferential surface of the fixing belt 22 which changed during a warm-up time period, a standby time period, and an image forming time period.

Figure 5:
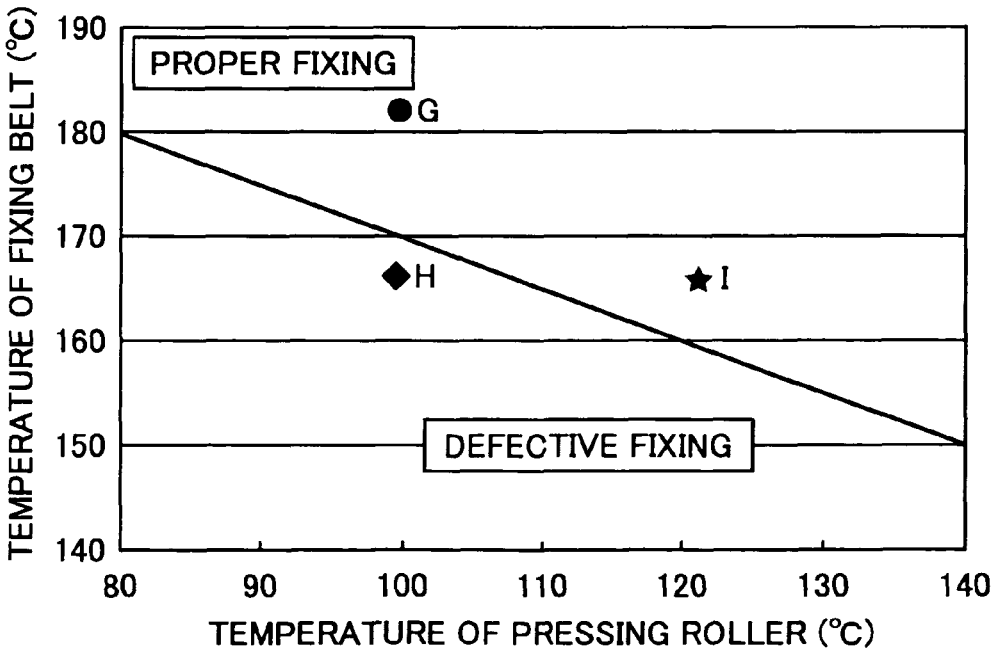
FIG. 5 is a graph illustrating a relationship between temperatures of the fixing belt and a pressing roller of the fixing unit shown in FIG. 2.

FIG. 5 illustrates a relationship between the temperatures of the outer circumferential surfaces of the fixing belt 22 and the pressing roller 30 when the fixing unit 130 was warmed up for about 30 seconds without the halogen heater 40 and the capacitor heater 41 for heating the pressing belt 30.

To warm up the fixing unit 130, whole power available in the fixing unit 130 is generally used to heat the fixing belt 22. In FIG. 5, a spot G shows the temperatures of the outer circumferential surfaces of the fixing belt 22 and the pressing roller 30 and fixing property when power of about 1,200 W allocated to the fixing unit 130 was used to heat the fixing belt 22 for about 30 seconds to warm up the fixing unit 130 without the halogen heater 40 and the capacitor heater 41 for heating the pressing roller 30.

The spot G shows that the temperatures of the outer circumferential surfaces of the fixing belt 22 and the pressing roller 30 may provide a proper fixing property. However, when the temperature of the outer circumferential surface of the fixing belt 22 was in a range of from about 180 degrees centigrade to about 190 degrees centigrade, the temperature of the outer circumferential surface of the pressing roller 30 was in a range of from about 90 degrees centigrade to about 100 degrees centigrade. Even when the halogen heater 40 heated the pressing roller 30 while the sheet P was conveyed in the fixing unit 130, the fixing temperature decreased, resulting in defective fixing. The pressing roller 30 needs to be heated with a different method. The temperature of the outer circumferential surface of the fixing belt 22 was too high.

A spot H shows the temperatures of the outer circumferential surfaces of the fixing belt 22 and the pressing roller 30 and fixing property when about 80 percent of the power allocated to the fixing unit 130 was used by the induction heater 24 to heat the fixing belt 22 and about 20 percent of the power was used by the halogen heater 40 to heat the pressing roller 30. The spot H shows that the temperatures of the outer circumferential surfaces of the fixing belt 22 and the pressing roller 30 did not provide a proper fixing property when the fixing unit 130 was warmed up for about 30 seconds. Therefore, the fixing unit 130 needs to be warmed up for more than about 30 seconds.

A spot I shows the temperatures of the outer circumferential surfaces of the fixing belt 22 and the pressing roller 30 and fixing property when the capacitor of the auxiliary power source 4 supplied power to the capacitor heater 41 to heat the pressing roller 30. The spot I shows that the temperatures of the outer circumferential surfaces of the fixing belt 22 and the pressing roller 30 were balanced and provided a proper fixing property. Thus, the fixing unit 130 may be warmed up for about 30 seconds when the capacitor of the auxiliary power source 4 supplies power to the capacitor heater 41 to drive the capacitor heater 41. The switch 5 controls the power supply from the auxiliary power source 4 to the capacitor heater 41 based on the temperature of the outer circumferential surface of the pressing roller 30 detected by the temperature sensor or the temperature of the outer circumferential surface of the fixing belt 22 detected by the thermistor 38.

To prevent the fixing temperature from decreasing when the image forming apparatus 100 in the standby mode starts an image forming operation, the switch 5 controls the power supply from the main power source 3 to the halogen heater 40 based on the temperature of the outer circumferential surface of the pressing roller 30 detected by the temperature sensor (e.g, the thermistor) contacting the pressing roller 30,so that the temperature of the pressing roller 30 reaches a predetermined temperature. The switch 5 may control the power supply so that the fixing temperature does not enter a defective fixing property area (i.e., a shaded area in FIG. 4). Namely, the switch 5 may control the power supply so that the fixing temperature is not lower than a lower limit of a proper fixing temperature illustrated in FIG. 4 during image forming operation.

As illustrated in FIG. 4, the fixing belt 22 needed more heat when several sheets P initially conveyed in the fixing unit 130 were fixed. After the several sheets P were fixed, the fixing temperature of the fixing belt 22 was thermally stabilized. Therefore, when the fixing temperature of the fixing belt 22 is thermally stabilized, the switch 5 may interrupt the power supply from the main power source 3 to the halogen heater 40 and power may be supplied to the induction heater 24 to heat the fixing belt 22. Thus, thermal energy may be effectively used to save energy. When an image forming operation is performed at an increased speed and the fixing belt 22 needs more heat, the switch 5 may control the power supply from the main power source 3 to the halogen heater 40 based on the temperature of the outer circumferential surface of the pressing roller 30 detected by the temperature sensor contacting the pressing roller 30 or the temperature of the outer circumferential surface of the fixing belt 22 detected by the thermistor 38, so that the temperature of the outer circumferential surface of the pressing roller 30 may reach a predetermined temperature.

The following describes a relationship between amounts of power supplied to the induction heater 24 and the capacitor heater 41 of the fixing unit 130.

$$WA < WI + WC$$

In the above inequality, WA represents a maximum amount of power supplied from the main power source 3 to the fixing unit 130. WI represents a maximum amount of power supplied from the main power source 3 to the induction heater 24. WC represents an amount of power supplied from the auxiliary power source 4 to the capacitor heater 41.

While the fixing unit 130 is warmed up, the switch 5 may control the power supply so that the main power source 3 supplies fill power (i.e., WA=WI) to the induction heater 24. The induction heater 24 does not need full power after the image forming apparatus 100 enters the standby mode and before an image fanning operation starts. Thus, the switch 5 may control the power supply so that the main power source 3 supplies properly allocated power to the induction heater 24 and the halogen heater 40. In this case, the capacitor heater 41 is not needed.

Referring to FIGS. 2 and 3, the following describes operations of the fixing unit 130. The driver drives the fixing roller 21 to rotate in the rotating direction C. The rotating fixing roller 21 rotates the fixing belt 22 in a rotating direction E. The rotating fixing belt 22 rotates the support roller 23 in the rotating direction D and the pressing roller 30 in a rotating direction F. The induction heater 24 heats a portion on the outer circumferential surface of the fixing belt 22 while the portion on the outer circumferential surface of the rotating fixing belt 22 opposes the induction heater 24. Specifically, the switch 5 controls the power supply so that the high-frequency power source of the main power source 3 applies a high-frequency alternating current to the coil 25 to form magnetic lines of force between the core 26 and the inside core 28. Directions of the magnetic lines of force alternately switch in opposite directions to form an alternating magnetic field. The magnetic field induces an eddy current on the surface of the support roller 23 and in the heating layer of the fixing belt 22. Electric resistances of the support roller 23 and the heating layer of the fixing belt 22 generate Joule heat to heat the support roller 23 and the heating layer of the fixing belt 22. The fixing belt 22 is heated by the heated support roller 23 and the heated heating layer of the fixing belt 22.

The portion on the outer circumferential surface of the fixing belt 22, which is heated by the induction heater 24, passes under the thermistor 38, and then reaches the fixing nip formed between the fixing belt 22 and the pressing roller 30. The heated portion on the outer circumferential surface of the fixing belt 22 applies heat to melt the toner image T on the sheet P conveyed in the direction Y Specifically, the sheet P having the toner image T is guided by the guide 35 and is conveyed in the direction Y to the fixing nip formed between the fixing belt 22 and the pressing roller 30 where the sheet P is sandwiched between the fixing belt 22 and the pressing roller 30. In the fixing nip, the toner image T is fixed on the sheet P by heat and pressure applied by the fixing belt 22 and the pressing roller 30. The sheet P having the fixed toner image T is fed out of the fixing nip.

After passing the fixing nip, the portion on the outer circumferential surface of the fixing belt 22 passes under the oil applying roller 34 and the thermopile 37, and then passes under the induction heater 24. The above-described operations are repeated to complete a fixing process.

The above-described structure of the image forming apparatus 100 may shorten the warm-up time period and may prevent the fixing temperature from decreasing immediately after the sheet P is conveyed in the fixing unit 130. However, the image forming apparatus 100 needs to reduce heat radiation from the fixing unit 130.

According to this non-limiting exemplary embodiment, the thermal insulator 50 is disposed on the interior of the housing 45*a* The thermal insulator 50 includes a vacuum thermal insulator having a thermal conductivity smaller than about 0.01 W/mK and may reduce heat radiation from the fixing unit 130 by about 5 to about 20 percent. For example, when the fixing unit 130 radiated heat of about 200 W, the thermal insulator 50 reduced radiated heat in a range of from about 10 W to about 40 W. Thus, the thermal insulator 50 could shorten a time period when the fixing temperature decreased when the sheets P were continuously conveyed in the fixing unit 130 after the fixing unit 130 in the standby mode started a fixing operation. A time period when the halogen heater 40 was turned on was also shortened, resulting in energy saving. The thermal insulator 50 may also be disposed on an interior of the housing 45*b*.

According to this non-limiting exemplary embodiment, the thermal insulator 50 may suppress heat radiation from the fixing unit 130, preventing the sheet P conveyed in the fixing unit 130 from decreasing the fixing temperature after the fixing unit 130 starts a fixing operation.

The thermal insulator 50 has the thermal conductivity shown in the following inequality:

$$k<0.01\ W/\mathrm{mK}$$

In the above inequality, k represents the thermal conductivity of the thermal insulator 50. Thus, the thermal insulator 50 has a low thermal conductivity. Therefore, the thermal insulator 50 may be formed in a thinner shape. Namely, when the thermal insulator 50 is configured to have a thickness common to general thermal insulators, the thermal insulator 50 may provide a thermal insulation which is increased by about 5 to about 20 percent. As a result, the thermal insulator 50 may shorten the time period when the fixing temperature decreases when the sheets P are continuously conveyed in the fixing unit 130 after the fixing unit 130 in the standby mode starts a fixing operation.

Figure 6:
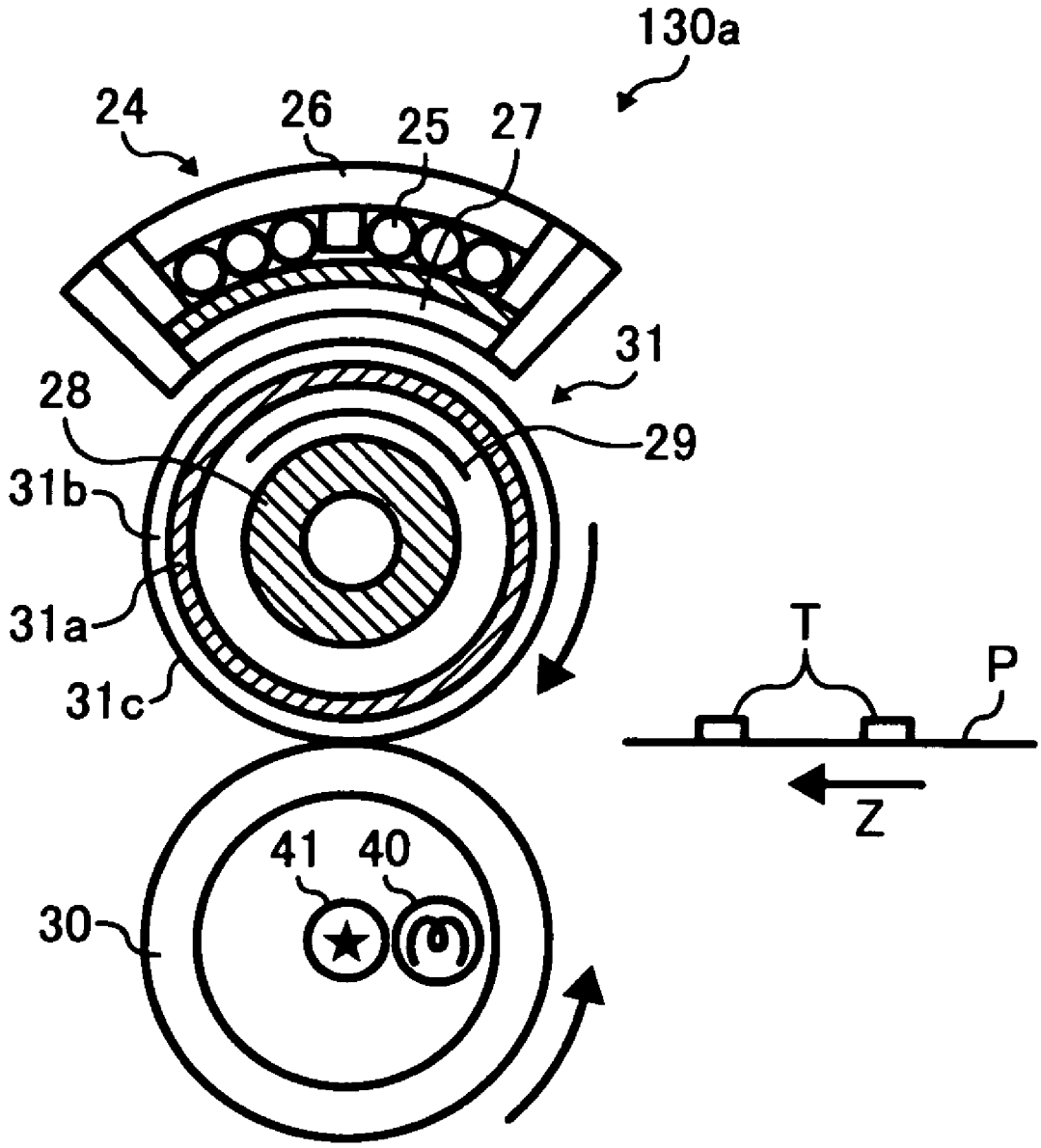
FIG. 6 is a sectional view of a fixing unit according to another exemplary embodiment of the present invention.

FIG. 6 illustrates a fixing unit 130*a* according to another exemplary embodiment of the present invention. As illustrated in FIG. 6, the fixing unit 130*a* includes the pressing roller 30, the halogen heater 40, the capacitor heater 41, the induction heater 24, the inside core 28, the shield 29, and a fixing roller 31. The induction heater 24 includes the coil 25, the core 26, and the coil guide 27. The fixing roller 31 includes a heat generating layer 3l*a*, an elastic layer 31*b*, and a releasing layer 31*c*.

The fixing roller 31 opposes the pressing roller 30 and applies heat to a sheet P having a toner image T to fix the toner image T on the sheet P when the sheet P is conveyed between the fixing roller 31 and the pressing roller 30. The heat generating layer 31 a includes a metal sleeve. The elastic layer 31*b* includes a silicone rubber. The releasing layer 3l*c* includes fluoroplastic. The fixing roller 31 includes a hollow and the inside core 28 and the shield 29 are rotatably disposed in the hollow.

The high-frequency power source of the main power source 3 applies an alternating current having a frequency in a range of from about 10 kHz to about 1 MHz to the coil 25 via the switch 5 to form magnetic lines of force between the core 26 and the inside core 28. Directions of the magnetic lines of force alternately switch in opposite directions to form an alternating magnetic field. The magnetic field induces an eddy current in the heat generating layer 31*a* of the fixing roller 31. Electric resistances of the heat generating layer 31*a* generate Joule heat to heat the fixing roller 31. The fixing roller 31 and the pressing roller 30 apply heat and pressure to the sheet P having the toner image T, which is conveyed in a direction Z so as to melt and fix the toner image T on the sheet P.

The image forming apparatus 100 including the fixing unit 130 or 130*a* includes a heating system for applying heat to a sheet P having a toner image T. As illustrated in FIG. 3, the heating system includes the heaters 2, the main power source 3, the auxiliary power source 4, and the switch 5. The heaters 2 of the fixing unit 130 include the halogen heater 40, the capacitor heater 4l, the fixing roller 21, the fixing belt 22, the support roller 23, the induction heater 24, and the pressing roller 30. The power supplied from the main power source 3 to the induction heater 24 and the halogen heater 40 via the switch 5 respectively causes the induction heater 24 and the halogen heater 40 to generate heat for heating the fixing belt 22 and the pressing roller 30. The power supplied from the auxiliary power source 4 to the capacitor heater 41 via the switch 5 causes the capacitor heater 41 to generate heat for heating the pressing roller 30.

The heaters 2 of the fixing unit 130*a* include the halogen heater 40, the capacitor heater 41, the fixing roller 31, the induction heater 24, and the pressing roller 30. The power supplied from the main power source 3 to the induction heater 24 and the halogen heater 40 via the switch 5 respectively causes the induction heater 24 and the halogen heater 40 to generate heat for heating the fixing roller 31 and the pressing roller 30. The power supplied from the auxiliary power source 4 to the capacitor heater 41 via the switch 5 causes the capacitor heater 41 to generate heat for heating the pressing roller 30.

The main power source 3 is connected to an outlet or the like provided on a wall or the like near the image forming apparatus 100 including the fixing unit 130 or 130*a* The main power source 3 adjusts a voltage for the heaters 2 and rectifies alternating and direct currents. The auxiliary power source 4 includes the capacitor capable of charging and discharging. The capacitor of the auxiliary power source 4 includes an electric double layer capacitor available from Nippon Chemi-Con Corporation, for example, having a capacitance of about 2,000 F which is sufficient to supply power for several seconds to several dozen seconds. The switch 5 connects or disconnects the main power source 3 and/or the auxiliary power source 4 to or from the heaters 2 so that the main power source 3 and/or the auxiliary power source 4 may supply or may not supply power to the heaters 2. The switch 5 connects the main power source 3 to the auxiliary power source 4 so that the main power source 3 may supply power to the auxiliary power source 4 to charge the capacitor of the auxiliary power source 4.

The switch 5 connects the main power source 3 to the heaters 2 so that the main power source 3 supplies predetermined power to the heaters 2 via the switch 5 to heat the heaters 2 up to a predetermined temperature. The switch 5 disconnects the main power source 3 from the heaters 2 and connects the main power source 3 to the auxiliary power source 4 in the standby mode so that the main power source 3 supplies power to the auxiliary power source 4 to charge the capacitor of the auxiliary power source 4. To warm up the fixing unit 130 or 130*a* in the standby mode, the switch 5 connects the main power source 3 to the heaters 2 (e.g., the induction heater 24 and the halogen heater 40) so that the main power source 3 supplies power to the induction heater 24 and the halogen heater 40. The switch 5 also connects the auxiliary power source 4 to the heater 2 (e.g., the capacitor heater 41). Thus, the capacitor of the auxiliary power source 4 supplies power to the capacitor heater 41.

To warm up the fixing unit 130 or 130*a* from the standby mode, both the main power source 3 and the auxiliary power source 4 may supply a substantial amount of power to the heaters 2 to warm up the fixing unit 130 or 130*a* to a predetermined temperature in a shortened time period. In the fixing unit 130, the switch 5 controls the power supply from the main power source 3 to the induction heater 24 and the halogen heater 40 and from the auxiliary power source 4 to the capacitor heater 41 based on temperatures detected by the thermopile 37 and/or the thermistor 38. In the fixing unit 130*a*, the switch 5 controls the power supply from the main power source 3 to the induction heater 24 and the halogen heater 40 and from the auxiliary power source 4 to the capacitor heater 41 based on a temperature detected by a temperature sensor (not shown) for detecting a surface temperature (i.e., a fixing temperature) of the fixing roller 31 and a temperature detected by a temperature sensor (not shown) for detecting a surface temperature of the pressing roller 30.

Figure 7:
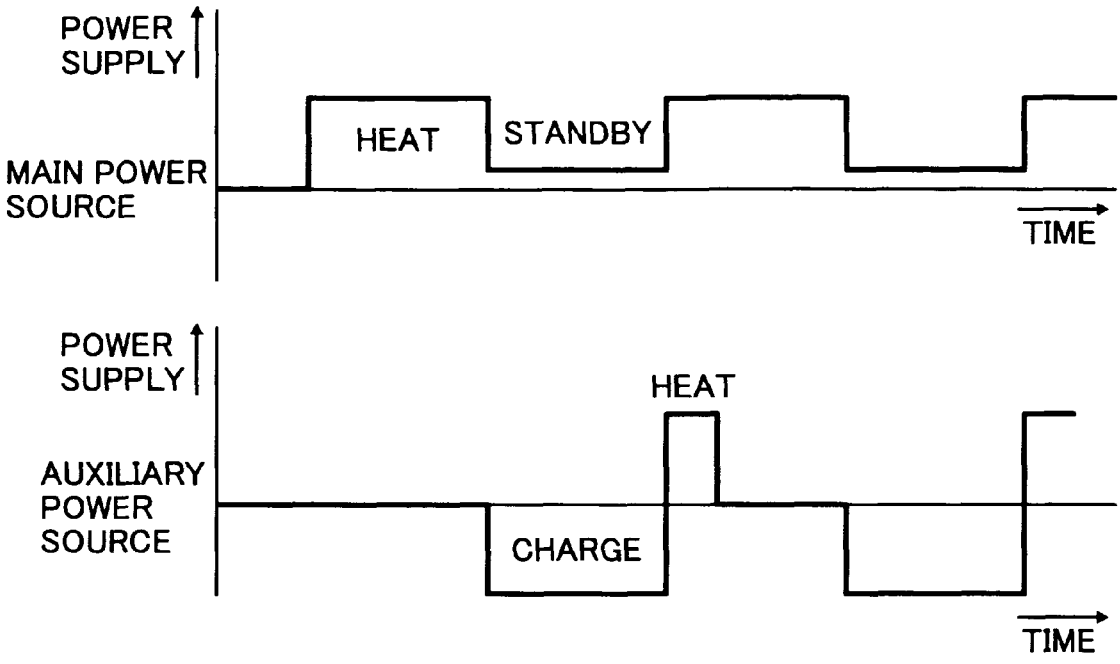
FIG. 7 is a waveform chart illustrating power supply controlled by a switch of the heating system shown in FIG. 3.
Figure 8:
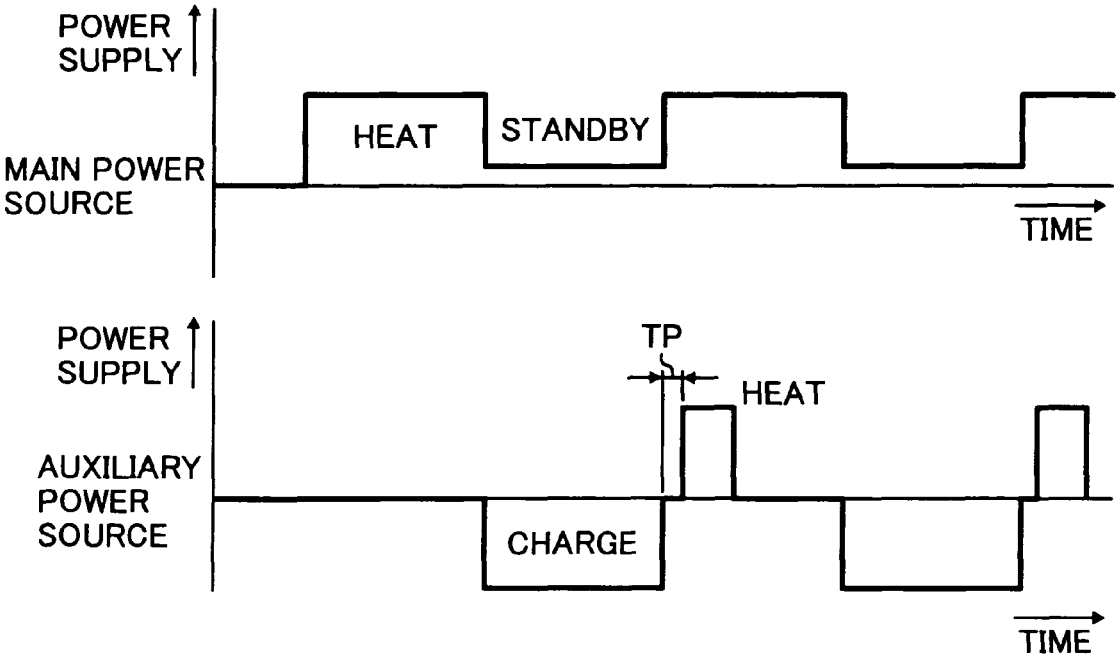
FIG. 8 is a waveform chart illustrating another power supply controlled by a switch of the heating system shown in FIG. 3.

Referring to FIGS. 7 and 8, the following describes the power supply controlled by the switch 5. When the fixing unit 130 or 130*a* is turned on, the switch 5 connects the main power source 3 to the induction heater 24 and the halogen heater 40 so that the main power source 3 supplies predetermined power to the induction heater 24 and the halogen heater 40. The induction heater 24 heats the fixing belt 22 or the fixing roller 31 up to a predetermined temperature and the halogen heater 40 heats the pressing roller 30 up to a predetermined temperature. The heated fixing belt 22 or the heated fixing roller 31 and the heated pressing roller 30 fix a toner image T on a sheet P. When the fixing unit 130 or 130*a* is in the standby mode, the switch 5 disconnects the main power source 3 from the induction heater 24 and the halogen heater 40 and connects the main power source 3 to the auxiliary power source 4 so that the main power source 3 supplies power to the auxiliary power source 4 to charge the capacitor of the auxiliary power source 4.

To warm up the fixing unit 130 or 130*a* in the standby mode, the switch 5 connects the main power source 3 to the induction heater 24 and the halogen heater 40 so that the main power source 3 supplies power to the induction heater 24 and the halogen heater 40. The induction heater 24 heats the fixing belt 22 or the fixing roller 31 and the halogen heater 40 heats the pressing roller 30. Simultaneously, the switch 5 connects the auxiliary power source 4 to the capacitor heater 41 so that the auxiliary power source 4 supplies power to the capacitor heater 41. The capacitor heater 41 heats the pressing roller 30 until the fixing unit 130 or 130*a* is warmed up to a predetermined temperature.

When the halogen heater 40 is turned on, an in-rush current occurs. The in-rush current may damage an electric circuit of the auxiliary power source 4. To prevent this, a time period TP is provided before the auxiliary power source 4 supplies power to the capacitor heater 41, as illustrated in FIG. 8.

The capacitor of the auxiliary power source 4, unlike a secondary battery, does not cause a chemical reaction. An auxiliary power source generally includes a nickel-cadmium battery as the secondary battery. However, it may take several hours to charge the nickel-cadmium battery. The capacitor of the auxiliary power source 4 may be charged within several minutes. When the fixing unit 130 or 130*a* alternately enters the standby mode and a heating mode, the auxiliary power source 4 may supply power to the capacitor heater 41. As a result, the fixing belt 22 or the fixing roller 31 may be heated up to a predetermined temperature in a shortened time period.

The nickel-cadmium battery may be charged and discharged up to about 500 to about 1,000 times and has a short life, increasing time and costs for replacement. The capacitor of the auxiliary power source 4 has a long life and may not be easily degraded by repeated charging and discharging. The capacitor of the auxiliary power source 4, unlike a lead-acid battery, may not need changing and replenishing liquid, resulting in reduced maintenance operations and increased user friendliness.

In the fixing unit 130 or 130*a*, power may be supplied to the induction heater 24 and the capacitor heater 41 according to the following inequality.

$$WA < WI + WC$$

In the above inequality, WA represents the maximum amount of power supplied from the main power source 3 to the fixing unit 130 or 130*a*. WI represents the maximum amount of power supplied from the main power source 3 to the induction heater 24. WC represents the amount of power supplied from the auxiliary power source 4 to the capacitor heater 41.

While the fixing unit 130 or 130*a* is warmed up, the main power source 3 may supply fill power allocated to the fixing unit 130 or 130*a* to the induction heater 24, shortening the warm-up time period of the fixing unit 130 or 130*a* Further, the capacitor heater 41 and the induction heater 24 may be simultaneously driven to reduce or prevent heat radiation to the pressing roller 30. Thus, power in an amount greater than the amount of power allocated to the fixing unit 130 or 130*a* may be supplied to the fixing unit 130 or 130*a*.

Figure 9:
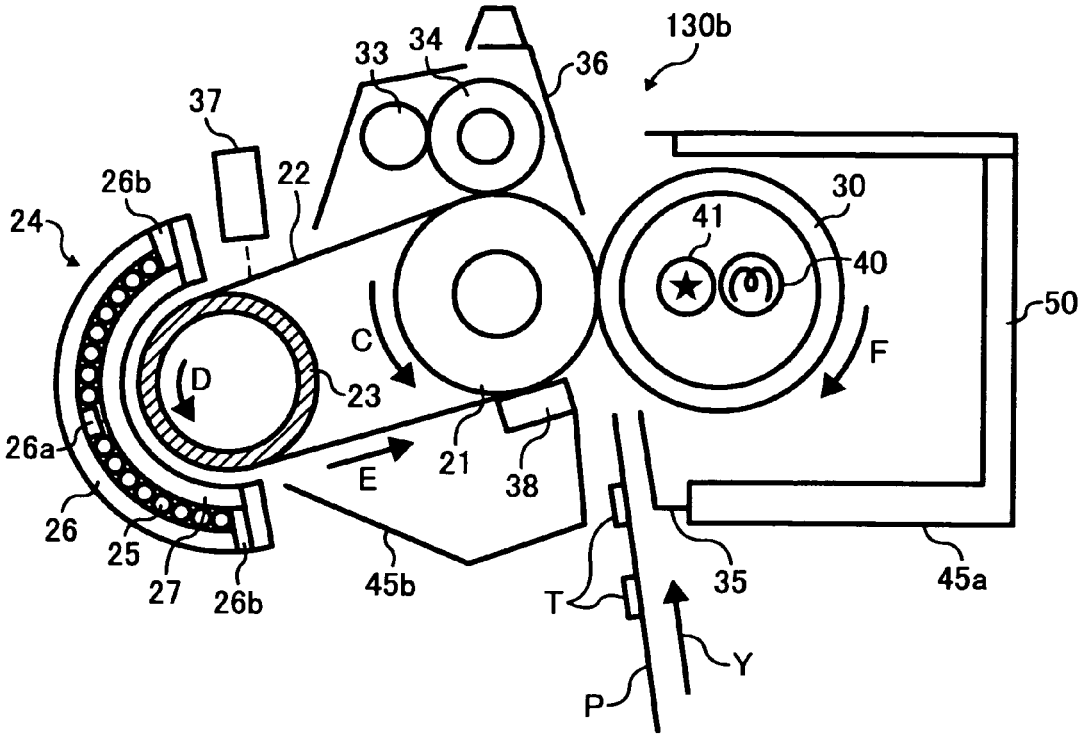
FIG. 9 is a sectional view of a fixing unit according to yet another exemplary embodiment of the present invention.

FIG. 9 illustrates a fixing unit 130*b* according to yet another exemplary embodiment of the present invention. The fixing unit 130*b* does not include the inside core 28 and the shield 29 illustrated in FIG. 2. The other elements of the fixing unit 130*b* are common to the fixing unit 130.

Figure 10:
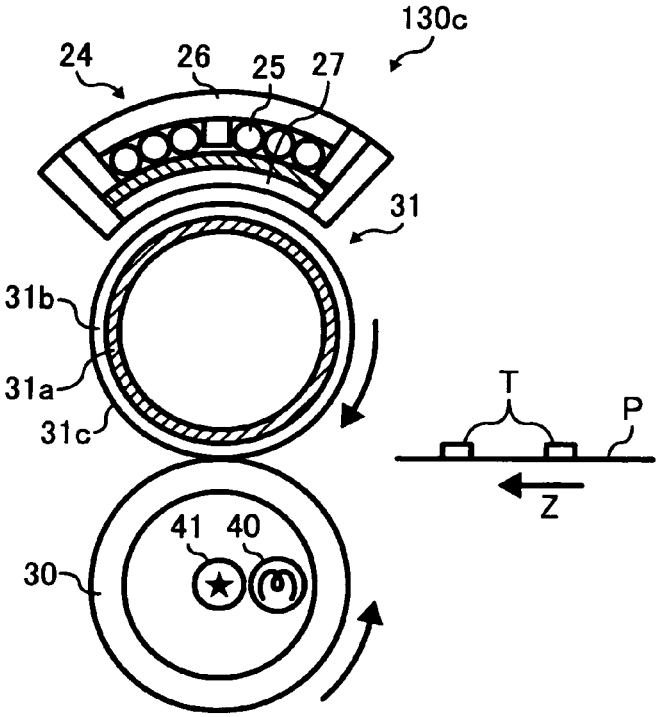
FIG. 10 is a sectional view of a fixing unit according to yet another exemplary embodiment of the present invention.

FIG. 10 illustrates a fixing unit 130*c* according to yet another exemplary embodiment of the present invention. The fixing unit 130*c* does not include the inside core 28 and the shield 29 illustrated in FIG. 6. The other elements of the fixing unit 130*c* are common to the fixing unit 130*a*.

Figure 11:
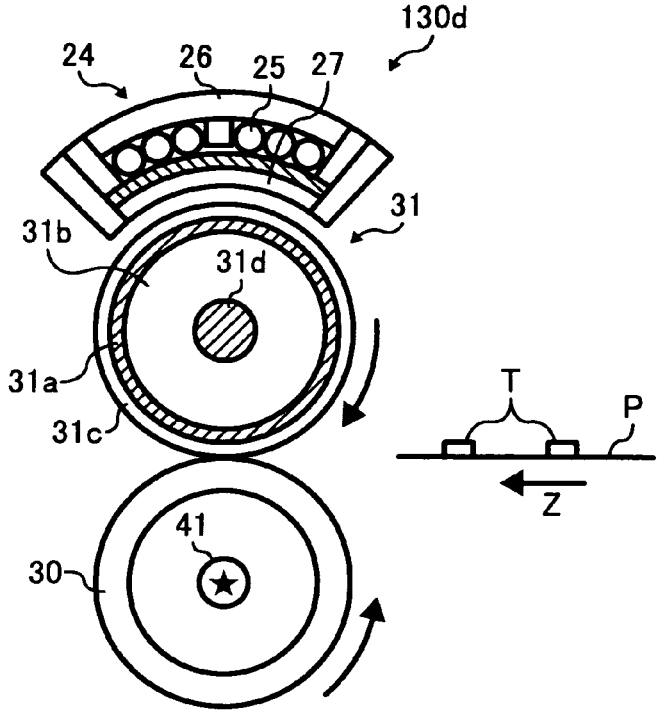
FIG. 11 is a sectional view of a fixing unit according to yet another exemplary embodiment of the present invention.

FIG. 11 illustrates a fixing unit 130*d* according to yet another exemplary embodiment of the present invention. The fixing unit 130*d* does not include the inside core 28, the shield 29, and the halogen heater 40 illustrated in FIG. 6, but includes a core 31*d* on which the elastic layer 31*b*, the heat generating layer 31*a*, and the releasing layer 31*c* are layered Another elastic layer 31*b* maybe formed between the heat generating layer 31*a* and the releasing layer 31*c*. The other elements of the fixing unit 130*d* are common to the fixing unit 130*a*.

Figure 12:
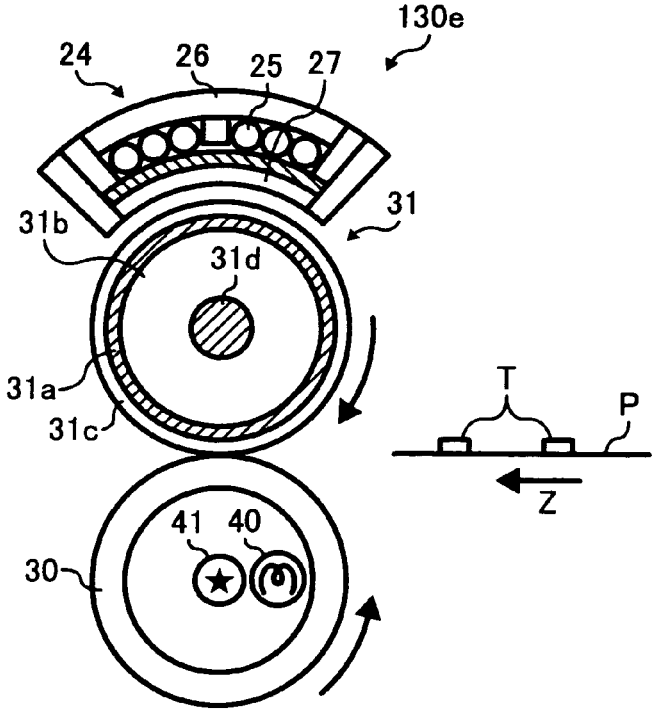
FIG. 12 is a sectional view of a fixing unit according to yet another exemplary embodiment of the present invention.

FIG. 12 illustrates a fixing unit 130*e* according to yet another exemplary embodiment of the present invention The fixing unit 130*e* does not include the inside core 28 and the shield 29 illustrated in FIG. 6, but includes a core 31*d* on which the elastic layer 31*b*, the heat generating layer 31*a*, and the releasing layer 31*c* are layered. Another elastic layer 31*b* may be formed between the heat generating layer 31*a* and the releasing layer 31*c*. The other elements of the fixing unit 130*e* are common to the fixing unit 130*a*.

The following describes atoner used in the fixing units 130, 130*a*, 130*b*, 130*c*, 130*d*, and 130*e*. Fixing property of a toner is generally affected by a softening point of the toner. However, the softening point of the toner does not affect the fixing property of the toner used in the fixing units 130, 130*a*, 130*b*, 130*c*, 130*d*, and 130*e*. A toner having a glass transition temperature in a range of from about 45 degrees centigrade to about 65 degrees centigrade and a flow start temperature in a range of from about 90 degrees centigrade to about 115 degrees centigrade may provide a proper fixing property.

When the glass transition temperature of the toner is lower than about 45 degrees centigrade, offset may occur during fixing. When the glass transition temperature of the toner is higher than about 65 degrees centigrade, a toner image on a sheet P may not be sufficiently fixed and the toner may peel off the sheet P. When the flow start temperature of the toner is lower than about 90 degrees centigrade, offset may occur during fixing. When the flow start temperature of the toner is higher than about 115 degrees centigrade, a toner image on a sheet P may not be sufficiently fixed and the toner may peel off the sheet P.

The following describes how to measure a glass transition point Tg of a toner. The glass transition point Tg was measured with TG-DSC series TAS-100 system available from Rigaku Corporation. A sample toner of about 10 mg was put into an aluminum sample container. The sample container was placed on a holder unit and was set into an electric fur. The electric furnace heated the sample toner in the sample container from a room temperature up to about 150 degrees centigrade at a speed of about 10 degrees centigrade per minute. The sample toner was kept at about 150 degrees centigrade for about 10 minutes. The sample toner was cooled down to the room temperature and was kept at the room temperature for about 10 minutes. The sample toner was heated up to about 150 degrees centigrade again in a nitrogen atmosphere at the speed of about 10 degrees centigrade per minute. The glass transition point Tg was measured in a differential scanning calorimetry method and was calculated with an analysis system of the TAS-100 system based on a tangent to an endothermic curve near the glass transition point Tg and a contact point to a base line.

The following describes how to measure a flow start temperature of a toner and how to calculate a ½ flow temperature. The flow start temperature was measured with a capillary type flow tester (e.g., Flow meter CFT-500D available from Shimadzu Corporation). A sample toner pressed and shaped was put into a cylinder having a die orifice diameter of about 1.00 mm and a die orifice length of about 10.0 mm and was heated up to a predetermined temperature. The sample toner was further heated at a speed of about 3.0 degrees centigrade per minute while a piston applied a load of about 5 kg/cm$^2$ to the sample toner. The piston moved downward as the sample toner melted. A distance for which the piston moved downward was measured.

Figure 13A:
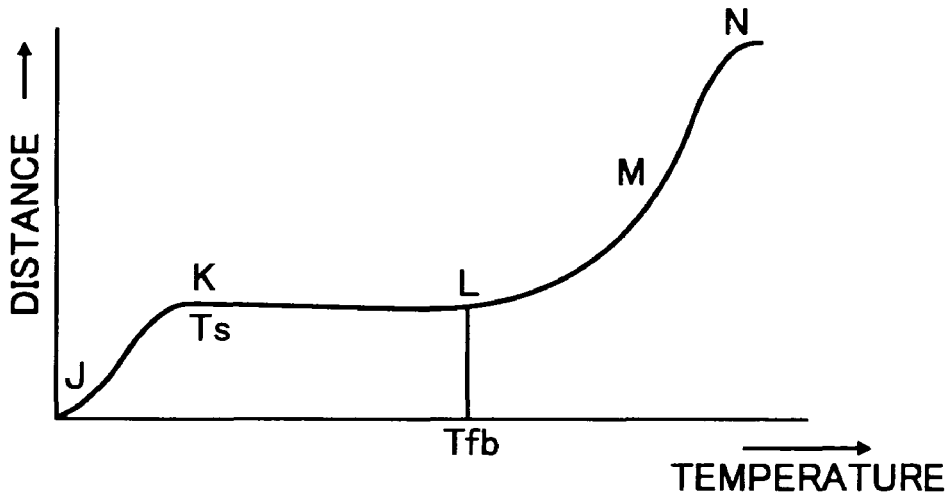
FIG. 13A is a graph illustrating a flow curve showing a flow start temperature of a toner.
Figure 13B:
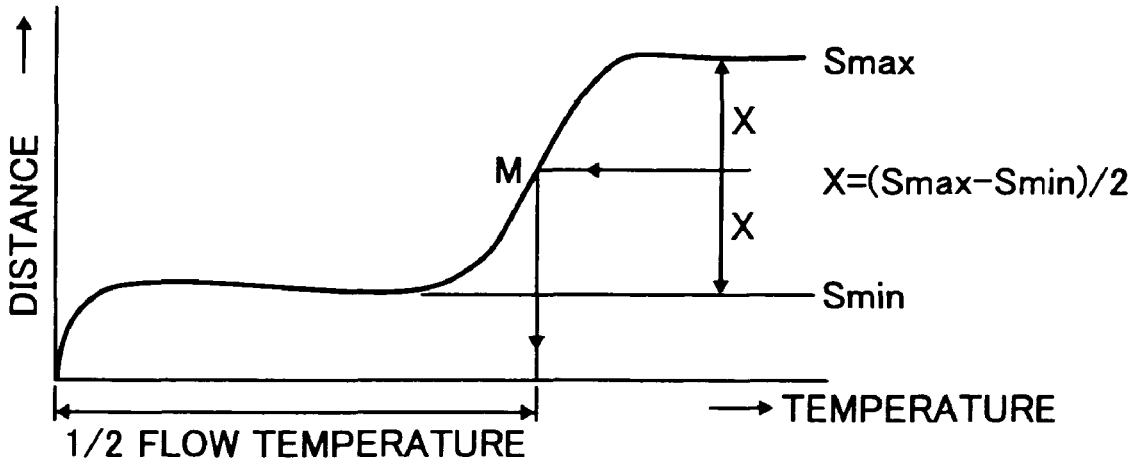
FIG. 13B is a graph illustrating a flow curve showing a ½ flow temperature of a toner.

FIGS. 13A and 13B illustrate flow curves created by the flow tester. In FIG. 13A, a spot J shows an upper limit temperature at which the sample toner was not deformed by heat and the piston did not move downward A spot K (i.e., a softening temperature Ts) shows a temperature at which the sample toner gummed. A spot L (i.e., a flow start temperature Tfb) shows a temperature at which the sample toner melted and started flowing. A spot N shows a temperature at which the sample toner finished flowing. A spot M shows a temperature (i.e., the ½ flow temperature) at which the piston moved downward for a half of a distance for which the piston moved downward from a time when the sample toner started flowing until the sample toner finished flowing.

In FIG. 13B, Smax represents the distance for which the piston moved downward from the time when the sample toner started flowing until the sample toner finished flowing. Smin represents the distance for which the piston moved downward until the sample toner started flowing. X represents the half of the distance for which the piston moved downward from the time when the sample toner started flowing until the sample toner finished flowing. The 1/2 flow temperature is calculated based on the distance represented by X.

The toner used in the fixing units 130, 130*a*, 130*b*, 130*c*, 130*d*, and 130*e* may include a binder resin which satisfies toner properties needed for the fixing units 130, 130*a*, 130*b*, 130*c*, 130*d*, and 130*e*. Examples of the binder resin may include mono-polymers of styrenes (e.g., polyester, polystyrene, poly-p-chlorostyrene, polyvinyltoluene, and/or the like) and substitutions of the above-described styrenes, styrene copolymers (e.g., a styrene-p-chlorostyrene copolymer, a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-methyl methacrylate copolymer, a styrene-ethyl methacrylate copolymer, a styrene-butyl methacrylate copolymer, a styrene-α-chloro methyl methacrylate copolymer, a styrene-acrylonitrile copolymer, a styrene-vinyl methyl ether copolymer, a styrene-vinyl ethyl ether copolymer, a styrene-vinyl methyl ketone copolymer, a styrene-butadiene copolymer, a styrene-isoprene copolymer, a styrene-acrylonitrile-indene copolymer, a styrene-maleic acid copolymer, a styrene-maleate copolymer, and/or the like), and/or the like.

The binder resin may be prepared by mixing resins described below. Examples of the resins may include polymethyl methacrylate, polybutyl methacrylate, polyvinyl chloride, polyvinyl acetate, polyethylene, polypropylene, polyurethane, polyamide, an epoxy resin, polyvinyl butyral, a polyacrylic resin, rosin, modified rosin, a terpene resin, a phenolic resin, an aliphatic or alicyclic hydrocarbon resin, an aromatic petroleum resin, chlorinated paraffin, paraffin wax, and/or the like.

Among the above-described resins, the polyester resin may be preferably used to provide sufficient fixing property. The polyester resin may be prepared by poly-condensation of an alcohol and a carboxylic acid. Examples of the alcohol may include diols (e.g., polyethylene glycol, diethylene glycol, triethylene glycol, 1,2-propylene glycol, 1,3-propylene glycol, 1,4-butanediol, neopentyl glycol, 1,4-butene diol, and/or the like), etherized bisphenols (e.g., 1,4-bis (hydroxymethyl) cyclohexane, bisphenol A, hydrogenated bisphenol A, polyexy ethylene bisphenol A, polyoxy propylene bisphenol A, and/or the like), a dihydric alcohol prepared by substituting the above-described alcohol with a saturated or unsaturated hydrocarbon radical having a carbon number in a range of from 3 to 22, the other dihydric alcohol, and/or the like.

Examples of the carboxylic acid used for preparing the polyester resin may include a maleic acid, a fumaric acid, a mesaconic acid, a citraconic acid, an itaconic acid, a glutaconic acid, a phthalic acid, an isophthalic acid, a terephthalic acid, a cyclohexanedicarboxylic acid, a succinic acid, an adipic acid, a sebacic acid, a malonic acid, a divalent organic acid monomer prepared by substituting the above-described carboxylic acid with a saturated or unsaturated hydrocarbon radical having a carbon number in a range of from 3 to 22, an acid anhydride of the above-described carboxylic acid, a dimer of a lower alkyl ester and a linolenic acid, the other divalent organic acid monomer, and/or the like.

Not only the above-described polymers including a bifunctional monomer but also polymers including a polyfunctional (e.g., trifunctional or more) monomer may be preferably used to prepare the polyester resin used as the binder resin. Examples of the polyfunctional monomer may include a polyhydric (e.g., trihydric or more) alcohol monomer (e.g., sorbitol, 1,2,3,6-hexane tetrol, 1,4-sorbitan, penta erythritol, dipenta erythritol, tripenta erythritol, sucrose, 1,2,4-butanetriol, 1,2,5-pentanetriol, glycerol, 2-methylpropanetriol, 2-methyl-1,2,4-butanetriol, trimethylolethane, trimethylolpropane, 1,3,5-trihydroxymethylbenzene, and/or the like), and/or the like.

Examples of the multivalent or more carboxylic acid monomer may include a 1,2,4-benzene tricarboxylic acid, a 1,2,5-benzene tricarboxylic acid, a 1,2,4-cyclohexane tricarboxylic acid, a 2,5,7-naphthalene tricarboxylic acid, a 1,2,4-naphthalene tricarboxylic acid, a 1,2,4-butane tricarboxylic acid, a 1,2,5-hexane tricarboxylic acid, a 1,3-dicarboxyl-2-methyl-2-methylene carboxy propane, a tetra(methylene carboxyl)methane, a 1,2,7,8-octane tetracarboxylic acid, an acid anhydride of the above-described carboxylic acid monomer, and/or the like.

The toner used in the fixing units 130, 130*a*, 130*b*, 130*c*, 130*d*, and 130*e* may include a releasing agent to enhance releasing property of the toner on the outer circumferential surface of the fixing belt 22 or the fixing roller 31. Examples of the releasing agent may include known releasing agents, particularly, a camauba wax from which a free aliphatic acid is removed, a montan wax, an oxidized rice wax, an ester wax, and a combination of two or more of the above-described waxes, and/or the like. The camauba wax may preferably include microcrystal and may have an acid number of 5 or less and a particle size of about 1 μm or less when the camauba wax is dispersed in the toner binder. The montan wax may be generally refined from mineral and may preferably include microcrystal and may have an acid number in a range of from 5 to 14. The oxidized rice wax may be prepared by oxidizing a rice bran wax in the air and may preferably have an acid number in a range of from 10 to 30. When each of the waxes has an acid number below the above-described range, a temperature of low temperature fixing may increase, resulting insufficient low temperature fixing. When each of the waxes has an acid number exceeding the above-described range, a cold offset temperature may increase, resulting in insufficient low temperature fixing. The wax in an amount in a range of from about 1 part by weight to about 15 parts by weight, preferably in a range of from about 3 parts by weight to about 10 parts by weight, may be added in the binder resin in an amount of about 100 parts by weight. When the wax in an amount of less than about 1 part by weight is added, the releasing property of the toner may degrade. When the wax in an amount of more than about 15 parts by weight is added, the toner may be excessively adhered to carriers.

The toner used in the fixing units 130, 130*a*, 130*b*, 130*c*, 130*d*, and 130*e* may include a charging control agent to enhance charging property of the toner. Examples of the charging control agent may include known charging control agents. Examples of a positive-charging control agent may include a nigrosine dye, a basic dye, a lake pigment of the basic dye, a quarternary ammonium salt compound, and/or the like. Examples of a negative-charging control agent may include a metallic salt of a monoazo dye, a metal complex of a salycyclic acid, a naphthoic acid, a dye carboxylic acid, and/or the like. An amount of the polar charging control agent may not be limited and may be determined based on a type of the binder resin, additives used if necessary, and a toner producing method including a dispersing method. The charging control agent in an amount in a range of from about 0.01 parts by weight to about 8 parts by weight, preferably in a range of from about 0.1 parts by weight to about 2 parts by weight, may be added in the binder resin in an amount of about 100 parts by weight. When the polar charging control agent in an amount of less than about 0.01 parts by weight is added, the charging property of the toner may degrade when charging quantity of the toner changes due to change of environmental conditions. When the polar charging control agent in an amount of more than about 7 parts by weight is added, low temperature fixing may degrade.

Examples of the monoazo dye including a metal may include a monoazo dye including chrome, a monoazo dye including cobalt, a monoazo dye including iron, and a combination of two or more of the above-described dyes. When the monoazo dye including the metal is added, the toner may be charged (i.e., saturated) in a shortened time period. An amount of the monoazo dye including the metal may not be limited and may be determined based on a type of the binder resin, additives used if necessary, and a toner producing method including a dispersing method. The monoazo dye including the metal in an amount in a range of from about 0.1 parts by weight to about 10 parts by weight, preferably in a range of from about 1 part by weight to about 7 parts by weight, maybe added in the binder resin in an amount of about 100 parts by weight. When the monoazo dye including the metal in an amount of less than about 0.1 parts by weight is added, the monoazo dye including the metal may not effectively work. When the monoazo dye including the metal in an amount of more than about 10 parts by weight is added, a saturation level may decrease.

A color toner may preferably include a metallic salt of a salicylic acid derivative. However, a transparent or white substance, which may not degrade a color tone, may be added if necessary to secure charging property of the toner. Examples of the transparent or white substance may include an organic boron salt, a quarternary ammonium salt including a fluorine, a calyx allene compound, and/or the like, but are not limited to the above-described salts or compound.

The toner used in the fixing units 130, 130*a*, 130*b*, 130*c*, 130*d*, and 130*e* may include a magnetic material and may be used as a magnetic toner. Examples of the magnetic material may include a ferric oxide (e.g., magnetite, hematite, ferrite, and/or the like), a metal (e.g., iron, cobalt, nickel, and/or the like), an alloy and a mixture of the above-described metal and a metal (e.g., aluminum, cobalt, copper, lead, magnesium, tin, zinc, antimony, beryllium, bismuth, cadmium, calcium, manganese, selenium, titanium, tungsten, vanadium, and/or the like), and/or the like.

The ferromagnet may preferably have an average particle size in a range of from about 0.1 μm to about 2.0 μm. The ferromagnet in an amount in a range of from about 20 parts by weight to about 200 parts by weight, preferably in a range of from about 40 parts by weight to about 150 parts by weight, may be contained in the resin component of about 100 parts by weight.

The toner used in the fixing units 130, 130*a*, 130*b*, 130*c*, 130*d*, and 130*e* may include a colorant Examples of the colorant may include known colorants (e.g., black, cyan, magenta, and yellow colorants). Examples of the black colorant may include carbon black, aniline black, fumace black, lampblack, and/or the like. Examples of the cyan colorant may include phthalocyanine blue, methylene blue, Victoria blue, methyl violet, aniline blue, ultramarine blue, and/or the like. Examples of the magenta colorant may include rhodamine 6G lake, dimethyl quinacridone, watching red, rose bengal, rhodamine B, alizarin lake, and/or the like. Examples of the yellow colorant may include chrome yellow, benzidine yellow, Hansa yellow, naphthol yellow, molybdenum orange, quinoline yellow, tatrazine, and/or the like. The colorant for the toner used in the fixing units 130, 130*a*, 130*b*, 130*c*, 130*d*, and 130*e* may include a dye and a pigment capable of preparing the black, cyan, magenta, and yellow toners. Examples of the dye and the pigment may include carbon black, lampblack, ultramarine, aniline blue, phthalocyanine blue, phthalocyanine green, Hansa yellow G, rhodamine 6G; lake, chalcone oil blue, chrome yellow, quinacridone, benzidine yellow, rose bengal, triarylmethane, a mixture of two or more of the above-described dyes and/or pigments, and/or the like.

The toner used in the fixing units 130, 130*a*, 130*b*, 130*c*, 130*d*, and 130*e* may include an additive to improve flow ability of the toner. Examples of the additive may include hydrophobic silica, titanium oxide, alumina, and/or the like. An aliphatic acid metallic salt, polyvinylidene fluoride, and/or the like may be added in the toner, if necessary.

When a two-component developer is used in the fixing unit 130 or 130*a*, the two-component developer may include known carriers. Examples of the carrier may include magnetic powder (e.g., iron powder, ferrite powder, nickel powder, and/or the like), glass bead, the magnetic powder coated with a resin and/or the like, the glass bead coated with a resin and/or the like, and/or the like.

Examples of the resin coating the carrier in the toner used in the fixing units 130, 130*a*, 130*b*, 130*c*, 130*d*, and 130*e* may include a styrene-acryl copolymer, a silicone resin, a maleic acid resin, fluoroplastic, a polyester resin, an epoxy resin, and/or the like. The styrene in the styrene-acryl copolymer may preferably occupy about 30 weight percent to about 90 weight percent. When the styrene occupies less than about 30 weight percent, developing property of the toner may degrade. When the styrene occupies more than about 90 weight percent, a coating film may be hardened and may be easily peeled off, resulting in a shortened life of the carrier. The resin coating the carrier may include an adhering agent, a hardening agent, a lubricant, a conductive material, a charge control agent, and/or the like.

The toner used in the fixing units 130, 130*a*, 130*b*, 130*c*, 130*d*, and 130*e* may include carrier core particles coated with the silicone resin. The carrier core particles may include known substances including a ferromagnet (e.g., iron, cobalt, nickel, and/or the like), an alloy and/or a compound of magnetite, hematite, ferrite, and/or the like, glass bead, and/or the like. The carrier core particles generally have an average particle size in a range of from about 10 μm to about 1,000 μm, preferably in a range of from about 30 μm to about 500 μm. The silicone rubber generally occupies about 1 weight percent to about 10 weight percent with respect to the carrier core particles.

The silicone resin in the toner used in the fixing units 130, 130*a*, 130*b*, 130*c*, 130*d*, and 130*e* may include known silicone resins. Examples of the silicone resin, which are commercially available, may include KR261, KR271, KR272, KR275, KR280, KR282, KR285, KR251, KR155, KR220, KR201, KR204, KR205, KR206, SA-4, ES1001, ES1001N, ES1002T, and KR3093 available from Shin-Etsu Chemical, Co., Ltd., SR2100, SR2101, SR2107, SR2110, SR2108, SR2109, SR2115, SR2400, SR2410, SR2411, SH805, SH806A, and SH840 available from Dow Coming Toray Corporation, and/or the like. The silicone resin may be applied to a surface of the carrier core particle by spraying, soaking, or the like.

The toner used in the fixing unit 130, 130*a*, 130*b*, 130*c*, 130*d*, and 130*e* includes at least the binder resin, the colorant, and the releasing agent. The toner has the glass transition temperature in the range of from about 45 degrees centigrade to about 65 degrees centigrade and the flow start temperature m the range of from about 90 degrees centigrade to about 115 degrees centigrade. The low flow start temperature may cause the toner to be fixed in a low fixing temperature, shortening a time period needed to heat the fixing belt 22, the fixing roller 31, and the pressing roller 30. The low flow start temperate may further reduce or prevent defective fixing caused by the fixing temperature decreased after the fixing unit 130, 130*a*, 130*b*, 130*c*, 130*d*, or 130*e* in the standby mode starts a fixing operation. Namely, the softening point of the toner does not affect fixing property of the toner used in the fixing units 130, 130*a*,130*b*, 130*c*, 130*d*, and 130*e*. The toner may provide proper fixing property when the toner has the glass transition temperature in the range of from about 45 degrees centigrade to about 65 degrees centigrade and the flow start temperature in the range of from about 90 degrees centigrade to about 115 degrees centigrade.

The following describes yet another exemplary embodiment of the present invention. According to this non-limiting exemplary embodiment, the switch 5 connects the auxiliary power source 4 to the capacitor heater 41 so that the auxiliary power source 4 supplies power to the capacitor heater 41 to drive the capacitor heater 41 until the fixing unit 130, 130*a*, 130*b*, 130*c*, 130*d*, or 130*e* is warmed up. The switch 5 connects the main power source 3 to the halogen heater 40 so that the main power source 3 supplies power to the halogen heater 40 to drive the halogen heater 40 while the fixing unit 130, 130*a*, 130*b*, 130*c*, 130*d*, or 130*e* is in the standby mode.

When the fixing unit 130, 130*a*, 130*b*, 130*c*, 130*d*, or 130*e* is warmed up, the capacitor heater 41 is driven by the auxiliary power source 4. The halogen heater 40 is driven by the main power source 3 only when the fixing unit 130, 130*a*, 130*b*, 130*c*, 130*d*, or 130*e* is in the standby mode. Therefore, the main power source 3 does not supply power to the halogen heater 40 and thereby may supply the maximum amount of power to the induction heater 24 when the fixing unit 130, 130*a*, 130*b*, 130*c*, 130*d*, or 130*e* is warmed up or when the fixing unit 130, 130*a*, 130*b*, 130*c*, 130*d*, or 130*e* is turned on after it is turned off. However, the main power source 3 may supply power to the halogen heater 40 to drive the halogen heater 40 when the fixing unit 130, 130*a*, 130*b*, 130*c*, 130*d*, or 130*e* is in the standby mode or immediately after a sheet P is fed in the fixing unit 130, 130*a*, 130*b*, 130*c*, 130*d*, or 130*e*, because the induction heater 24 consumes less power when the fixing unit 130, 130*a*, 130*b*, 130*c*, 130*d*, or 130*e* is in the standby mode or immediately after a sheet P is fed in the fixing unit 130, 130*a*, 130*b*, 130*c*, 130*d*, or 130*e*.

According to this non-limiting exemplary embodiment, the auxiliary power source 4 (e.g., the electric double layer capacitor) may supply power to the capacitor heater 41 to prevent the fixing belt 22 or the fixing roller 31 from radiating heat to the pressing roller 30 having the high heat capacity, resulting in a shortened warm-up time period of the fixing unit 130, 130*a*, 130*b*, 130*c*, 130*d*, and 130*e*. The fixing unit 130, 130*a*, 130*b*, 130*c*, 130*d*, and 130*e* may further include the halogen heater 40 to reduce power consumption. The thermal insulator 50 suitable for the induction heater 24 may be selected and used to further reduce power consumption.

According to the above-described embodiments, the auxiliary power source 4 (e.g., the electric double layer capacitor) may supply power to the capacitor heater 41. Thus, the capacitor heater 41 may heat the pressing roller 30 anytime regardless of how much power is consumed by the induction heater 24.

The present invention is also applicable to a heating system for heating a recording medium having an image to reform a surface of the recording medium and a heating system for drying or laminating a recording medium having a sheet-like shape.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention

What is claimed is:

1. An image forming apparatus, comprising:

an image forming mechanism configured to form a toner image on a recording medium with a toner according to image data;

a fixing unit configured to fix the toner image on the recording medium and including, a first heating member configured to face a front side of the recording medium bearing the toner image to apply heat to the recording medium, a second heating member configured to face a back side of the recording medium not bearing the toner image to apply heat to the recording medium, and a first heater provided inside the second heating member and configured to heat the second heating member;

an auxiliary power source configured to drive the first heater; and a main power source configured to supply power, the fixing unit further including a second heater configured to heat the second heating member, and wherein the auxiliary power source drives the first heater when the fixing unit is warmed up and the main power source drives the second heater when the fixing unit is in a standby mode, and the fixing unit further includes a magnetic flux generator configured to heat the first heating member by induction heating, and wherein the main power source supplies power to the magnetic flux generator and the auxiliary power source supplies power to the first heater in accordance with a following inequality:

$$WA < WI + WC$$

where WA represents a maximum amount of power supplied by the main power source to the fixing unit, WI represents a maximum amount of power supplied by the main power source to the magnetic flux generator, and WC represents an amount of power supplied by the auxiliary power source to the first heater.

2. An image forming apparatus, comprising:

an image forming mechanism configured to form a toner image on a recording medium with a toner according to image data;

a fixing unit configured to fix the toner image on the recording medium and including, a magnetic flux generator configured to generate a magnetic flux, a main power source configured to supply power to the magnetic flux generator, a first rotating member heated by the magnetic flux generated by the magnetic flux generator, a second rotating member configured to face a back side of the recording medium not bearing the toner image, a first heater configured to heat the second rotating member, and an auxiliary power source configured to supply power to the first heater, wherein the main power source supplies power to the magnetic flux generator, and the auxiliary power source supplies power to the first heater in accordance with a following inequality:

$$WA < WI + WC$$

where WA represents a maximum amount of power supplied by the main power source to the fixing unit, WI represents a maximum amount of power supplied by the main power source to the magnetic flux generator, and WC represents an amount of power supplied by the auxiliary power source to the first heater.

3. The image forming apparatus according to claim 2, wherein the fixing unit further includes a second heater configured to heat the second rotating member, and wherein the auxiliary power source drives the first heater when the fixing unit is warmed up and the main power source drives the second heater when the fixing unit is in a standby mode.

4. The image forming apparatus according to claim 2, wherein the fixing unit further includes a thermal insulator configured to suppress heat dispersion out of the fixing unit.

5. The image forming apparatus according to claim 4, wherein the thermal insulator has a thermal conductivity smaller than about 0.01 W/mK.

6. The image forming apparatus according to claim 2, wherein the first rotating member has a belt shape.

7. The image forming apparatus according to claim 2, wherein the first rotating member has a roller shape.

8. The image forming apparatus according to claim 2, wherein the auxiliary power source supplies power to the first heater when the recording medium is conveyed through the fixing unit to fix the toner image on the recording medium.

* * * * *